US011208712B2

(12) United States Patent
Kizu et al.

(10) Patent No.: US 11,208,712 B2
(45) Date of Patent: Dec. 28, 2021

(54) GALVANIZED STEEL SHEET AND METHOD FOR MANUFACTURING THE SAME

(71) Applicant: JFE STEEL CORPORATION, Tokyo (JP)

(72) Inventors: Taro Kizu, Tokyo (JP); Noriaki Moriyasu, Tokyo (JP); Shigeyuki Nabeshima, Tokyo (JP); Kazunori Tahara, Tokyo (JP); Kana Sasaki, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 331 days.

(21) Appl. No.: 16/483,500

(22) PCT Filed: Feb. 1, 2018

(86) PCT No.: PCT/JP2018/003328
§ 371 (c)(1),
(2) Date: Aug. 5, 2019

(87) PCT Pub. No.: WO2018/143318
PCT Pub. Date: Aug. 9, 2018

(65) Prior Publication Data

US 2021/0017636 A1 Jan. 21, 2021

(30) Foreign Application Priority Data

Feb. 6, 2017 (JP) ..... JP2017-019276

(51) Int. Cl.
*C23C 2/06* (2006.01)
*C22C 38/12* (2006.01)

(52) U.S. Cl.
CPC ..... *C23C 2/06* (2013.01); *C22C 38/12* (2013.01); *Y10T 428/12799* (2015.01)

(58) Field of Classification Search
None
See application file for complete search history.

(56) References Cited

FOREIGN PATENT DOCUMENTS

| | | | |
|---|---|---|---|
| CN | 101960034 | A | 1/2011 |
| EP | 2 256 224 | A1 | 12/2010 |
| EP | 2 546 377 | A1 | 1/2013 |
| EP | 2 762 584 | A1 | 8/2014 |

(Continued)

OTHER PUBLICATIONS

Apr. 24, 2018 International Search Report issued in International Patent Application No. PCT/JP2018/003328.

(Continued)

*Primary Examiner* — Daniel J. Schleis
(74) *Attorney, Agent, or Firm* — Oliff PLC

(57) ABSTRACT

There is provided a galvanized steel sheet more highly excellent in terms of punchability. The steel sheet has a specified chemical composition and a microstructure including a ferrite phase and a tempered bainite phase in a total amount of 95% or more in terms of area ratio, in which the average grain diameter of the microstructure is 5.0 μm or less, the amount of Fe precipitated is 0.10 mass % or more, the amount of Ti, Nb, and V precipitated in the form of precipitates having a grain diameter of less than 20 nm is 0.025 mass % or more in terms of precipitate C equivalent, and half or more of precipitates having a grain diameter of less than 20 nm are formed at random.

10 Claims, 2 Drawing Sheets

(56) References Cited

FOREIGN PATENT DOCUMENTS

| | | | |
|---|---|---|---|
| EP | 2 765 211 | A1 | 8/2014 |
| EP | 2 799 562 | A1 | 11/2014 |
| EP | 3 296 415 | A1 | 3/2018 |
| JP | 2002-322539 | A | 11/2002 |
| JP | 2009-7659 | A | 1/2009 |
| JP | 2009-263685 | A | 11/2009 |
| JP | 2013-124395 | A | 6/2013 |
| JP | 2013-216936 | A | 10/2013 |
| JP | 2015-63748 | A | 4/2015 |
| JP | 2015-78398 | A | 4/2015 |
| WO | 2010/131303 | A1 | 11/2010 |
| WO | 2016/157896 | A1 | 10/2016 |
| WO | 2017/006563 | A1 | 1/2017 |
| WO | 2017/017933 | A1 | 2/2017 |

OTHER PUBLICATIONS

Jun. 18, 2021 Office Action issued in Chinese Patent Application No. 201880009978.0.

Nov. 21, 2019 Extended European Search Report issued in European Patent Application No. 18748344.1.

Sep. 21, 2020 Office Action issued in Chinese Patent Application No. 201880009978.0.

GALVANIZED STEEL SHEET AND METHOD FOR MANUFACTURING THE SAME

TECHNICAL FIELD

This application relates to a galvanized steel sheet and a method for manufacturing the steel sheet. In particular, the application relates to a high-strength galvanized steel sheet excellent in terms of punchability which can most suitably be used as a material for structural members used for suspension members such as lower arms and frames, skeleton members such as pillars and members, stiffening members of the skeleton members, door impact beams, and seat members of automobiles, for structural members used for, for example, vending machines, desks, home electrical appliances, office automation devices, and building materials, and for other kinds of structural members and to a method for manufacturing the steel sheet.

BACKGROUND

Nowadays, in response to growing concerns about global environmental problems, there is an increasing demand for decreasing the amount of a used steel sheet manufactured with a large amount of $CO_2$ emission. Moreover, for example, there is an ever-increasing need for increasing fuel efficiency and decreasing exhaust gas emissions by decreasing the weight of automobiles in the automobile industry. Therefore, there is a trend toward decreasing the thickness of a steel sheet by using a high-strength steel sheet. Although examples of high-strength steel having high press formability include precipitation-strengthened steel, a problem of cracking occurring in a punched end surface when punching work is performed becomes noticeable due to an increase in the strength of a steel sheet, and such a tendency becomes more noticeable in the case of a galvanized steel sheet.

As an example of a conventional galvanized steel sheet excellent in terms of press formability, Patent Literature 1 discloses a steel sheet having a chemical composition containing, by weight %, C: less than 0.10%, Ti: 0.03% to 0.10%, and Mo: 0.05% to 0.6%, and a microstructure substantially consisting of a ferrite single phase matrix in which fine precipitates having a grain diameter of less than 10 nm are dispersed and in which Fe carbides having an average grain diameter of less than 1 μm are included in an amount of 1% or less in terms of volume fraction and a method for manufacturing the steel sheet. Moreover, Patent Literature 2 discloses a galvannealed hot-rolled steel sheet excellent in terms of ductility and hole expansion formability having a chemical composition containing, by mass %, C: 0.03% or more and 0.15% or less, Si: 0.5% or less, Mn: 1% or more and 4% or less, P: 0.05% or less, S: 0.01% or less, N: 0.01% or less, Al: 0.5% or less, and Ti: 0.11% or more and 0.50% or less and a microstructure including one or both of martensite and austenite in a total amount of 1 volume % or more and 8 volume % or less, and a balance of one or both of ferrite and bainite, in which Ti-containing precipitates are included in an amount of 0.2 volume % or more and a method for manufacturing the steel sheet. In addition, as an example of a steel sheet whose properties are less likely to be deteriorated after cutting has been performed, Patent Literature 3 discloses a steel sheet having a chemical composition containing, by mass %, C: 0.05% to 0.20%, Si: 0.3% to 2.00%, Mn: 1.3% to 2.6%, P: 0.001% to 0.03%, S: 0.0001% to 0.01%, Al: less than 0.10%, N: 0.0005% to 0.0100%, and O: 0.0005% to 0.007% and a microstructure including mainly ferrite and bainite, in which a Mn-segregation degree in the thickness direction (=(peak Mn concentration in the central portion)/(average Mn concentration)) is 1.20 or less and a method for manufacturing the steel sheet. Moreover, Patent Literature 4 discloses a steel sheet excellent in terms of punchability having a chemical composition containing, by mass %, C: 0.06% or more and 0.13% or less, Si: 0.5% or less, Mn: less than 0.5%, P: 0.03% or less, S: 0.005% or less, Al: 0.1% or less, N: 0.01% or less, Ti: 0.14% or more and 0.25% or less, and V: 0.01% or more and 0.5% or less and a microstructure including a ferrite phase in an amount of 95% or more in terms of area ratio, in which the average crystal grain diameter of the ferrite phase is 10 μm or less and in which the average grain diameter of carbides in the crystal grains of the ferrite phase is less than 10 nm and a method for manufacturing the steel sheet.

CITATION LIST

Patent Literature

PTL 1: Japanese Unexamined Patent Application Publication No. 2002-322539

PTL 2: Japanese Unexamined Patent Application Publication No. 2013-216936

PTL 3: Japanese Unexamined Patent Application Publication No. 2009-263685

PTL 4: Japanese Unexamined Patent Application Publication No. 2013-124395

SUMMARY

Technical Problem

However, in the case of the techniques described in Patent Literature 1 and Patent Literature 2, there is a problem of insufficient punchability. In addition, in the case of the technique described in Patent Literature 3, there is a problem in that it is not possible to improve punchability in the case where strength is largely increased through precipitation strengthening. Moreover, in the case of the technique described in Patent Literature 4, there is a problem of a deterioration in punchability in the case where a clearance is large when punching is performed.

The disclosed embodiments have been completed in view of the situation described above, and an object of the disclosed embodiments is to provide a galvanized steel sheet more highly excellent in terms of punchability and a method for manufacturing the steel sheet.

Solution to Problem

The disclosed embodiments have been completed as a result of diligent investigations conducted to solve the problems described above and has the following constituent features.

[1] A galvanized steel sheet having a chemical composition containing, by mass %, C: 0.08% to 0.20%, Si: 0.5% or less, Mn: 0.8% to 1.8%, P: 0.10% or less, S: 0.030% or less, Al: 0.10% or less, N: 0.010% or less, one, two, or all of Ti: 0.01% to 0.3%, Nb: 0.01% to 0.1%, and V: 0.01% to 1.0%, in which C* derived by using equation (1) below is 0.07 or more, and a balance of Fe and inevitable impurities, and a microstructure including a ferrite phase and a tempered bainite phase in a total amount of 95% or more in terms of area ratio, in which an average grain diameter of the microstructure is 5.0 μm or less, in which an amount of Fe precipitated is 0.10 mass % or more, in which an amount of Ti, Nb, and V precipitated in a form of precipitates having a grain diameter of less than 20 nm is 0.025 mass % or more in terms of precipitate C equivalent derived by using formula (2) below, and in which half or more of precipitates having a grain diameter of less than 20 nm are formed at random.

$$C^*=(Ti/48+Nb/93+V/51)\times 12 \quad (1)$$

Here, the atomic symbols in equation (1) respectively denote the contents (mass %) of the corresponding elements.

$$([Ti]/48+[Nb]/93+[V]/51)\times 12 \quad (2)$$

Here, [Ti], [Nb], and [V] in equation (2) respectively denote the amounts (mass %) of Ti, Nb, and V precipitated in the form of precipitates having a grain diameter of less than 20 nm.

[2] The galvanized steel sheet according to item [1], in which the chemical composition further contains, by mass %, one, two, or all of Mo: 0.005% to 0.50%, Ta: 0.005% to 0.50%, and W: 0.005% to 0.50%.

[3] The galvanized steel sheet according to item [1] or [2], in which the chemical composition further contains, by mass %, one, two, or all of Cr: 0.01% to 1.0%, Ni: 0.01% to 1.0%, and Cu: 0.01% to 1.0%.

[4] The galvanized steel sheet according to any one of items [1] to [3], in which the chemical composition further contains, by mass %, one or both of Ca: 0.0005% to 0.01% and REM: 0.0005% to 0.01%.

[5] The galvanized steel sheet according to any one of items [1] to [4], in which the chemical composition further contains, by mass %, Sb: 0.005% to 0.050%.

[6] The galvanized steel sheet according to any one of items [1] to [5], in which the chemical composition further contains, by mass %, B: 0.0005% to 0.0030%.

[7] A method for manufacturing a galvanized steel sheet, the method including casting steel having the chemical composition according to any one of items [1] to [6] to obtain a slab, performing rough rolling on the slab which is in a cast state or has been subjected to cooling followed by reheating to a temperature of 1200° C. or higher, performing finish rolling on the rough-rolled slab with a finishing delivery temperature of 850° C. or higher so that a cumulative strain, which is a sum of accumulated strains $R_1$ through $R_m$ of finish rolling utilizing m stands, is 0.7 or more, where $r_n$ is defined as a rolling reduction ratio of the n-th stand, where $T_n$ (° C.) is defined as a temperature at an entry side of the n-th stand, and where $R_n$ is defined as an accumulated strain in the n-th stand and calculated by using the equation $R_n=r_n(1-\exp\{-11000(1+C^*)/(T_n+273)+8.5\})$, cooling the finish-rolled steel sheet at an average cooling rate of 30° C./s or more in a temperature range from the finishing delivery temperature to a temperature of 650° C., coiling the cooled steel sheet at a coiling temperature of 350° C. or higher and 600° C. or lower, and pickling the coiled steel sheet, annealing the pickled steel sheet at a soaking temperature of 650° C. to 770° C. for a soaking time of 10 seconds to 300 seconds, and dipping the annealed steel sheet in a galvanizing bath having a temperature of 420° C. to 500° C. to galvanize the annealed steel sheet, and cooling the galvanized steel sheet at an average cooling rate of 10° C./s or less in a temperature range of 400° C. to 200° C.

Here, in the case where a value of the expression $\exp\{-11000(1+C^*)/(T_n+273)+8.5\}$ in the equation above for calculating the accumulated strain $R_n$ is more than 1, the expression is assigned a value of 1.

[8] The method for manufacturing a galvanized steel sheet according to item [7], the method further including reheating the steel sheet, after the dipping in the galvanizing bath having a temperature of 420° C. to 500° C. to galvanize the steel sheet, to a temperature of 460° C. to 600° C., holding the reheated steel sheet for 1 second or more, and cooling the held steel sheet at an average cooling rate of 10° C./s or less in a temperature range of 400° C. to 200° C.

[9] The method for manufacturing a galvanized steel sheet according to item [7] or [8], the method further including performing work on the steel sheet, after the cooling at an average cooling rate of 10° C./s or less in a temperature range of 400° C. to 200° C., with a thickness reduction ratio of 0.1% to 3.0%.

Although the mechanism by which punchability is improved in the disclosed embodiments is not necessarily clear, it is considered as follows. That is, as a result of utilizing cementite, which is a carbide of Fe, and precipitates (fine precipitates) having a grain diameter of less than 20 nm which are formed at random, since the cementite becomes a starting point at which void is formed when punching is performed, and since the fine precipitates, which do not show a particular distribution, promote the growth of a crack in the punching direction and decrease the crystal grain diameter of the microstructure, it is possible to prevent a crack from growing in a particular direction, which results in a smooth punched end surface being obtained.

Incidentally, steel sheets for which the disclosed embodiments are intended are a galvanized steel sheet and a galvannealed steel sheet, and steel sheets which are obtained by forming coating films on such steel sheets by performing, for example, a chemical conversion treatment.

Advantageous Effects

The galvanized steel sheet according to the disclosed embodiments is excellent in terms of punchability.

The galvanized steel sheet according to the disclosed embodiments has excellent punchability, even in the case where a clearance is large when punching is performed.

According to the disclosed embodiments, it is possible to obtain a galvanized steel sheet having high strength and excellent punchability as a result of forming a prescribed microstructure, in which precipitates having a grain diameter of less than 20 nm are formed at random and cementite are formed, by performing hot rolling on a steel slab having controlled contents of C, Si, Mn, P, S, Al, N, Ti, Nb, and V with a rolling reduction ratio, a rolling temperature, a cooling rate after rolling has been performed, and a coiling temperature being controlled, and by performing annealing, a galvanizing treatment, and cooling with a soaking temperature, a soaking time, and a cooling rate being controlled, which produces an industrially effective result.

DETAILED DESCRIPTION

Figure 1:
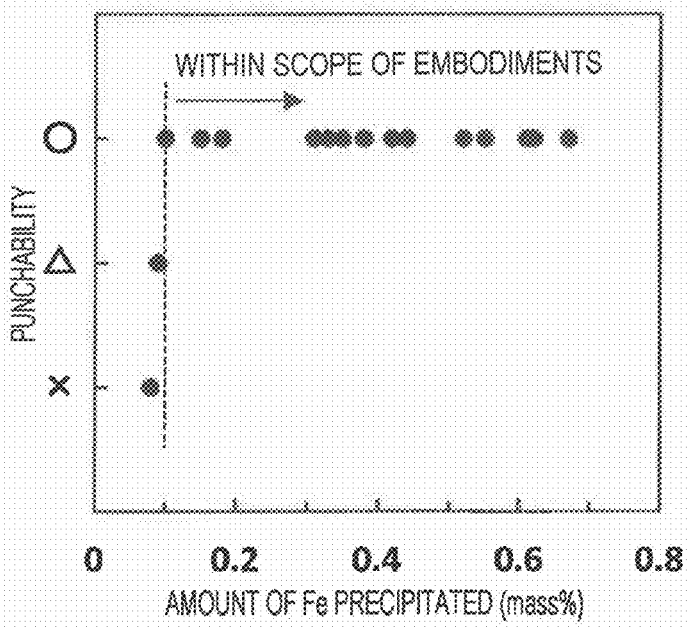
FIG. 1 is a diagram illustrating the relationship between the amount of Fe precipitated and punchability.

Hereafter, the disclosed embodiments will be specifically described.

First, the chemical composition of the galvanized steel sheet according to the disclosed embodiments will be described. Hereinafter, "%" used when describing the content of constituents means "mass %", unless otherwise noted.

[Chemical Composition]

C: 0.08% to 0.20%

C contributes to increasing strength by forming fine carbides with Ti, Nb, and V and contributes to improving punchability by forming cementite with Fe. To realize such effects, it is necessary that the C content be 0.08% or more. On the other hand, a large amount of C promotes martensite transformation and inhibits the formation of fine carbides with Ti, Nb, and V. In addition, an excessively large amount of C deteriorates weldability and significantly deteriorates toughness and formability. Therefore, it is necessary that the C content be 0.20% or less. It is preferable that the C content be 0.15% or less or more preferably 0.12% or less.

Si: 0.5% or less

Si causes bare spots by forming oxides on the surface of a steel sheet. Moreover, since Si causes fine precipitates (Ti-, Nb-, or V-based carbides) having a grain diameter of less than 20 nm to be formed in arrays by promoting ferrite transformation, such precipitates are inhibited from being formed at random, and there is an increase in the crystal grain diameter of a microstructure. Therefore, it is necessary that the Si content be 0.5% or less. It is preferable that the Si content be 0.2% or less, more preferably 0.1% or less, or even more preferably 0.05% or less. Although there is no particular limitation on the lower limit of the Si content, there is no problem, even in the case where Si is contained in an amount of 0.005% as an inevitable impurity.

Mn: 0.8% to 1.8%

Mn decreases crystal grain diameter by delaying ferrite transformation and contributes to increasing strength through solid solution strengthening. To realize such effects, it is necessary that the Mn content be 0.8% or more. It is preferable that the Mn content be 1.0% or more. On the other hand, a large amount of Mn causes cracking to occur in a slab and promotes martensite transformation. Therefore, it is necessary that the Mn content be 1.8% or less. It is preferable that the Mn content be 1.5% or less.

P: 0.10% or less

P deteriorates weldability and deteriorates ductility, bendability, and toughness as a result of being segregated at grain boundaries. Moreover, in the case where the P content is large, since P causes fine precipitates to be formed in arrays by promoting ferrite transformation, the fine precipitates are inhibited from being formed at random, and there is an increase in crystal grain diameter. Therefore, it is necessary that the P content be 0.10% or less. It is preferable that the P content be 0.05% or less, more preferably 0.03% or less, or even more preferably 0.01% or less. Although there is no particular limitation on the lower limit of the P content, there is no problem, even in the case where P is contained in an amount of 0.005% as an inevitable impurity.

S: 0.030% or less

S deteriorates weldability and significantly deteriorates surface quality by causing hot cracking as a result of significantly deteriorating hot ductility. Moreover, S hardly contributes to strengthening and functions as an impurity element which deteriorates ductility, bendability, and stretch flange formability by forming sulfides having a large grain diameter. Since such problems become marked in the case where the S content is more than 0.030%, it is preferable that the S content be as small as possible. Therefore, it is necessary that the S content be 0.030% or less. It is preferable that the S content be 0.010% or less, more preferably 0.003% or less, or even more preferably 0.001% or less. Although there is no particular limitation on the lower limit of the S content, there is no problem, even in the case where S is contained in an amount of 0.0001% as an inevitable impurity.

Al: 0.10% or less

In the case where the Al content is large, since Al causes fine precipitates to be formed in arrays by promoting ferrite transformation, the fine precipitates are inhibited from being formed at random, and there is an increase in crystal grain diameter. Moreover, Al causes bare spots by forming oxides on the surface of a steel sheet. Therefore, it is necessary that the Al content be 0.10% or less. It is preferable that the Al content be 0.06% or less. Although there is no particular limitation on the lower limit of the Al content, there is no problem, even in the case where Al is contained in an amount of 0.01% for aluminum killed steel.

N: 0.010% or less

Since N forms, with Ti, Nb, and V, nitrides having a large grain diameter at a high temperature and contributes less to strengthening, N decreases the effect of increasing strength due to the addition of Ti, Nb, and V and deteriorates toughness. Moreover, in the case where the N content is large, since N causes cracking to occur in a slab during hot rolling, there is a risk of surface defects occurring. Therefore, it is necessary that the N content be 0.010% or less. It is preferable that the N content be 0.005% or less, more preferably 0.003% or less, or even more preferably 0.002% or less. Although there is no particular limitation on the lower limit of the N content, there is no problem, even in the case where N is contained in an amount of 0.0005% as an inevitable impurity.

One, two, or all of Ti: 0.01% to 0.3%, Nb: 0.01% to 0.1%, and V: 0.01% to 1.0% with the relationship $C^*=(Ti/48+Nb/93+V/51)\times 12\geq 0.07$ being satisfied Ti, Nb, and V contribute to increasing strength by forming fine carbides with C. To realize such an effect, it is necessary that at least one of Ti, Nb, and V be added in an amount of 0.01% or more and that the contents of Ti, Nb, and V be controlled so that C*, which is derived by using equation (1) below, is 0.07 or more. On the other hand, in the case where the contents of Ti, Nb and V are large, that is, the Ti content is more than 0.3%, the Nb content is more than 0.1%, or the V content is more than 1.0%, while there is almost no increase in the effect of increasing strength, there is a deterioration in toughness due to a large amount of fine precipitates being formed. Therefore, it is necessary that the upper limits of the contents of Ti, Nb, and V be respectively 0.3%, 0.1%, and 1.0%.

$$C^*=(Ti/48+Nb/93+V/51)\times 12 \quad (1)$$

Here, the atomic symbols in equation (1) respectively denote the contents (mass %) of the corresponding elements, and the symbol of an element which is not added is assigned a value of 0.

The remainder is Fe and inevitable impurities. In the disclosed embodiments, the following elements may be added to improve strength and punchability.

One, two, or all of Mo: 0.005% to 0.50%, Ta: 0.005% to 0.50%, and W: 0.005% to 0.50%

Mo, Ta, and W contribute to increasing strength by forming fine precipitates with C. To realize such an effect, in the case where at least one of Mo, Ta, and W is added, it is preferable that at least one of Mo, Ta, and W be added in an amount of 0.005% or more. On the other hand, in the case where Mo, Ta, or W is added in a large amount, while there is almost no increase in the effect of increasing strength, there is a deterioration in toughness due to a large amount of fine precipitates being formed. Therefore, in the case where at least one of Mo, Ta, and W is added, it is preferable that the content of each of Mo, Ta, and W be 0.50% or less.

One, two, or all of Cr: 0.01% to 1.0%, Ni: 0.01% to 1.0%, and Cu: 0.01% to 1.0%

Cr, Ni, and Cu contribute to increasing strength and improving punchability by decreasing the grain diameter of a microstructure and by functioning as solid solution-strengthening elements. To realize such effects, in the case where at least one of Cr, Ni, and Cu is added, it is preferable that at least one of Cr, Ni, and Cu be added in an amount of 0.01% or more. On the other hand, in the case where Cr, Ni, or Cu is added in a large amount, while such effects become saturated, there is a deterioration in coatability. Therefore, in the case where at least one of Cr, Ni, and Cu is added, it is preferable that the content of each of Cr, Ni, and Cu be 1.0% or less.

One or both of Ca: 0.0005% to 0.01% and REM: 0.0005% to 0.01%

Ca and REM can improve ductility and toughness by controlling the shape of sulfides. To realize such effects, in the case where at least one of Ca and REM is added, it is preferable that at least one of Ca and REM be added in an amount of 0.0005% or more. On the other hand, in the case where Ca or REM is added in a large amount, there is a risk of a deterioration in ductility. Therefore, in the case where at least one of Ca and REM is added, it is preferable that the content of each of Ca and REM be 0.01% or less.

Sb: 0.005% to 0.050%

Since Sb is segregated on the surface of a slab when hot rolling is performed, Sb can inhibit the formation of coarse nitrides by preventing the nitridation of a slab. To realize such an effect, in the case where Sb is added, it is preferable that the Sb content be 0.005% or more. On the other hand, in the case where a large amount of Sb is added, such an effect becomes saturated, and there is a deterioration in workability. Therefore, in the case where Sb is added, it is preferable that the Sb content be 0.050% or less.

B: 0.0005% to 0.0030%

B can contribute to improving punchability by decreasing the grain diameter of a microstructure. To realize such an effect, in the case where B is added, it is preferable that the B content be 0.0005% or more or more preferably 0.0010% or more. On the other hand, since there is a risk in that a large amount of B increases rolling load when hot rolling is performed, in the case where B is added, it is preferable that the B content be 0.0030% or less or more preferably 0.0020% or less.

In addition, there is no influence on the properties of a steel sheet, even in the case where impurities such as Sn, Mg, Co, As, Pb, Zn, and O are contained in a total amount of 0.5% or less.

Hereafter, the microstructure of the galvanized steel sheet according to the disclosed embodiments will be described.

Ferrite phase and tempered bainite phase in a total amount of 95% or more in terms of area ratio Since a ferrite phase and a tempered bainite phase are excellent in terms of ductility, it is necessary that the total amount of a ferrite phase and a tempered bainite phase be 95% or more in terms of area ratio. It is preferable that the total amount of a ferrite phase and a tempered bainite phase be 98% or more or more preferably 100% in terms of area ratio.

Average grain diameter of microstructure: 5.0 μm or less

In the case where the average grain diameter of a microstructure is large, there is a deterioration in punchability. Therefore, it is necessary that the average grain diameter of a microstructure (average crystal grain diameter of the whole microstructure) be 5.0 μm or less. It is preferable that the average grain diameter of a microstructure be 3.0 μm or less.

Amount of Fe precipitated: 0.10 mass % or more

Cementite contributes to improving punchability by functioning as a starting point at which a void is formed when punching is performed. To realize such an effect, it is necessary that the amount of Fe which is precipitated in the form of cementite (the amount of Fe precipitated) be 0.10 mass % or more. It is preferable that the amount of Fe precipitated be 0.20 mass % or more. On the other hand, although there is no particular limitation on the upper limit of the amount of Fe precipitated, a large amount of cementite deteriorates some kinds of formability, such as hole expansion formability, and toughness. Therefore, it is preferable that the amount of Fe precipitated be 0.60 mass % or less or more preferably 0.40 mass % or less.

Precipitate C equivalent of Ti, Nb, and V precipitated in the form of precipitates having a grain diameter of less than 20 nm: 0.025 mass % or more Precipitates having a grain diameter of less than 20 nm contribute to strengthening. To realize such an effect, it is necessary that the amount of Ti, Nb, and V precipitated in the form of precipitates having a grain diameter of less than 20 nm be 0.025 mass % or more in terms of precipitate C equivalent derived by using formula (2) below. It is preferable that the precipitate C equivalent be 0.035 mass % or more. On the other hand, although there is no particular limitation on the upper limit of the precipitate C equivalent, there is a deterioration in toughness in the case where the amount of precipitates having a grain diameter of less than 20 nm is large. Therefore, it is preferable that the precipitate C equivalent be 0.10 mass % or less, more preferably 0.08 mass % or less, or even more preferably 0.05 mass % or less.

$$([Ti]/48+[Nb]/93+[V]/51)\times 12 \quad (2)$$

Here, [Ti], [Nb], and [V] in equation (2) respectively denote the amounts (mass %) of Ti, Nb, and V precipitated in the form of precipitates having a grain diameter of less than 20 nm.

Half or more of precipitates having a grain diameter of less than 20 nm: formed at random In the case where precipitates having a grain diameter of less than 20 nm show a particular distribution, that is, in the case where such precipitates are formed in arrays in a direction, since a crack grows in the particular direction of the distribution when punching is performed, a large crack occurs in the punched end surface. Since such end-surface cracking becomes marked in the case where more than half of the precipitates having a grain diameter of less than 20 nm show a particular distribution, it is necessary that half or more of the precipitates having a grain diameter of less than 20 nm be formed at random.

Here, in the disclosed embodiments, the area ratios of a ferrite phase and a tempered bainite phase, the average grain diameter of a microstructure, the amount of Fe precipitated, the precipitate C equivalent of Ti, Nb, and V precipitated in the form of precipitates having a grain diameter of less than 20 nm, the proportion of precipitates formed at random in the group of precipitates having a grain diameter of less than 20 nm, and mechanical properties such as tensile strength (TS) are determined by using the methods described in EXAMPLES.

Although there is no particular limitation on the TS of the galvanized steel sheet according to the disclosed embodiments, it is preferable that the TS be 980 MPa or more. Also, although there is no particular limitation on the thickness of the steel sheet, it is preferable that the thickness be 4.0 mm or less, more preferably 3.0 mm or less, even more preferably 2.0 mm or less, or even much more preferably 1.5 mm or less. The lower limit of the thickness should be about 1.0 mm, which is the lower limit of the thickness of a steel sheet manufacturable by performing hot rolling.

Hereafter, the conditions for manufacturing the galvanized steel sheet according to the disclosed embodiments will be described. Here, in the description below, the term "temperature" refers to the surface temperature of, for example, a steel sheet.

In the disclosed embodiments, steel (slab) into which steel having the chemical composition described above is cast is used as a starting material.

There is no particular limitation on the method for manufacturing the starting material, and examples of the method include one in which molten steel having the chemical composition described above is prepared by using a commonly used method such as one which utilizes a converter and in which the molten steel is cast into steel (slab) by using, for example, a continuous casting method.

Slab: in the cast state or subjected to cooling followed by reheating to a temperature of 1200° c. or higher To finely precipitate Ti, Nb, and V, it is necessary that precipitates formed in a slab be dissolved before rolling is started. For this purpose, it is necessary that a slab (having a high temperature) in the cast state be transported to the entry side of a hot rolling mill to start rough rolling or that a slab which has been cooled so as to become a warm piece or a cold piece, in which Ti, Nb, and V are precipitated, be reheated to a temperature of 1200° C. or higher before rough rolling is started. Although there is no particular limitation on the holding time at a temperature of 1200° C. or higher, it is preferable that the holding time be 10 minutes or more or more preferably 30 minutes or more. In addition, it is preferable that the reheating temperature be 1220° C. or higher or more preferably 1250° C. or higher.

Cumulative strain in finish rolling stands: 0.7 or more

After rough rolling has been performed, finish rolling is performed in finish rolling stands. At this time, by controlling the cumulative strain in the finish rolling stands, it is possible to decrease the crystal grain diameter of a microstructure. For this purpose, it is necessary that a cumulative strain $R_t$, which is the sum of accumulated strains ($R_t=R_1+R_2+\ldots+R_m$) of finish rolling utilizing m stands, be 0.7 or more, where $r_n$ is defined as a rolling reduction ratio of the n-th stand, where $T_n$ (° C.) is defined as a temperature at the entry side of the n-th stand, and where $R_n$ is defined as the accumulated strain in the n-th stand and calculated by using the equation $R_n=r_n(1-\exp\{-11000(1+C^*)/(T_n+273)+8.5\})$. It is preferable that the cumulative strain $R_t$ be 1.0 or more or more preferably 1.5 or more. Although there is no particular limitation on the upper limit of the cumulative strain $R_t$, it is sufficient that the upper limit be about 2.0.

The rolling reduction ratio $r_n$ of the n-th stand is defined by the equation $r_n=-1n(t_n/t_{n-1})$, where $t_{n-1}$ is defined as a thickness at the entry side of the n-th stand, and where $t_n$ is defined as a thickness at the exit side of the n-th stand. In addition, in the case where the value of the expression $\exp\{-11000(1+C^*)/(T_n+273)+8.5\}$ in the equation above for calculating the accumulated strain $R_n$ is more than 1, the expression is assigned a value of 1.

Finishing delivery temperature: 850° C. or higher

In the case where the finishing delivery temperature is low, the coarse carbides of Ti, Nb, and V are precipitated due to strain-induced precipitation. Therefore, it is necessary that the finishing delivery temperature be 850° C. or higher. It is preferable that the finishing delivery temperature be 880° C. or higher. Although there is no particular limitation on the upper limit of the finishing delivery temperature, it is sufficient that the upper limit be about 950° C.

Average cooling rate in temperature range from finishing delivery temperature to a temperature of 650° C.: 30° C./s or more After finish rolling has been performed, in the case where the average cooling rate in a temperature range from the finishing delivery temperature to a temperature of 650° C. is low, since ferrite transformation occurs at a high temperature, there is an increase in the average grain diameter of a microstructure, and the coarse carbides of Ti, Nb, and V are precipitated. In addition, phase-interface precipitation occurs in such a manner that the carbides of Ti, Nb, and V are precipitated at the interface between austenite and ferrite when transformation occurs, that is, the precipitates show a particular distribution, which results in a deterioration in punchability. Therefore, it is necessary that the average cooling rate in a temperature range from the finishing delivery temperature to a temperature of 650° C. be 30° C./s or more. It is preferable that the average cooling rate be 50° C./s or more preferably 80° C./s or more or more. Although there is no particular limitation on the upper limit of the average cooling rate, it is sufficient that the upper limit be about 200° C./s from the view point of temperature control.

Coiling temperature: 350° c. or higher and 600° c. or lower

In the case where the coiling temperature is high, since ferrite transformation is promoted, phase-interface precipitation occurs in such a manner that the carbides of Ti, Nb, and V are precipitated at the interface between austenite and ferrite when transformation occurs, that is, the precipitates show a particular distribution, which results in a deterioration in punchability. Therefore, it is necessary that the coiling temperature be 600° C. or lower. It is preferable that the coiling temperature be 550° C. or lower. On the other hand, in the case where the coiling temperature is low, since bainite transformation is inhibited, martensite transformation is promoted. Therefore, it is necessary that the coiling temperature be 350° C. or higher. It is preferable that the coiling temperature be 400° C. or higher.

Subsequently, the hot-rolled coil after coiling has been performed is subjected to pickling followed by annealing.

Soaking temperature: in a temperature range of 650° C. to 770° C.

The carbides of Ti, Nb, and V are not precipitated in the case where the soaking temperature is low when annealing is performed, and it is possible to precipitate the carbides of Ti, Nb, and V finely and at random by controlling the soaking temperature to be high. For this purpose, it is necessary that the soaking temperature be 650° C. or higher. It is preferable that the soaking temperature be 700° C. or higher or more preferably 730° C. or higher. On the other hand, in the case where the soaking temperature is excessively high, coarsening of the carbides of Ti, Nb, and V occurs. In addition, since austenite transformation occurs when soaking is performed, bainite transformation and martensite transformation progress when cooling is performed after soaking has been performed. Therefore, it is necessary that the soaking temperature be 770° C. or lower.

Soaking time (retention time in a soaking temperature range): 10 seconds to 300 seconds In the case where the soaking time is short when soaking is performed, the carbides of Ti, Nb, and V are not precipitated in a sufficient amount. Therefore, it is necessary that the soaking time be 10 seconds or more. It is preferable that the soaking time be 30 seconds or more. On the other hand, in the case where the soaking time is long, coarsening of the carbides of Ti, Nb, and V occurs, and there is an increase in crystal grain diameter. Therefore, it is necessary that the soaking time be 300 seconds or less. It is preferable that the soaking time be 150 seconds or less.

After annealing has been performed, the annealed steel sheet is dipped in a galvanizing bath having a temperature of 420° C. to 500° C. to galvanize the annealed steel sheet and cooled thereafter.

Cooling at an average cooling rate of 10° c./s or less in a temperature range of 400° c. to 200° c.

In the case where the cooling rate is high after dipping in the galvanizing bath has been performed, since cementite is inhibited from being precipitated, there is a deterioration in punchability. Therefore, it is necessary that cooling be performed at a cooling rate of 10° C./s or less in a temperature range of 400° C. to 200° C., in which fine cementite is precipitated.

Here, after dipping in the galvanizing bath has been performed, the galvanized steel sheet may be reheated to a temperature of 460° C. to 600° C. and held 1 second or more to obtain a galvannealed steel sheet. It is preferable the holding time be 1 second to 10 seconds.

Moreover, after a coating treatment has been performed as described above, light work may be performed on the coated steel sheet to improve punchability as a result of increasing the number of movable dislocations. Examples of such light work include one which is performed with a thickness reduction ratio of 0.1% or more. It is preferable that the thickness reduction ratio be 0.3% or more. On the other hand, in the case where the thickness reduction ratio is large, since dislocations are less likely to move due to interaction between the dislocations, there is a deterioration in punchability. Therefore, in the case where such light work is performed, it is preferable that the thickness reduction ratio be 3.0% or less, more preferably 2.0% or less, or even more preferably 1.0% or less. Here, when such light work is performed, rolling may be performed by using rolling rolls, or a steel sheet may be subjected to tensile work by applying tension to the steel sheet. Moreover, a combination of rolling and tensile work may be performed.

EXAMPLES

The examples of the disclosed embodiments will be described.

Steels having the chemical compositions given in Table 1 were made into slabs by using a continuous casting method. The slabs were reheated to a temperature of 1250° C., subjected to rough rolling, and subjected to finish rolling (utilizing 7 stands) followed by cooling and coiling under the conditions given in Table 2 to obtain hot-rolled coils. The hot-rolled coils were subjected to pickling followed by annealing and then dipped in a galvanizing bath having a temperature of 470° C. for a coating treatment to obtain galvanized steel sheets, that is, sample Nos. 1 through 30. Moreover, after the coating treatment had been performed, some of the samples were subjected to a reheating treatment under the conditions given in Table 2 and subjected to work with the thickness reduction ratios given in Table 2. Here, in Table 2, "–" in the column "Reheating Temperature", "Holding Time", or "Thickness Reduction Ratio" indicates that the treatment corresponding to the column was not performed.

TABLE 1

| Sample | Chemical Composition (mass %) | | | | | | | | | | | |
|---|---|---|---|---|---|---|---|---|---|---|---|---|
| No. | C | Si | Mn | P | S | Al | N | Ti | Nb | V | Other | C* |
| 1 | 0.13 | 0.01 | 1.0 | 0.02 | 0.02 | 0.04 | 0.003 | | | 0.45 | Cr = 0.2, Ni = 0.3, Cu = 0.3 | 0.106 |
| 2 | 0.20 | 0.5 | 1.5 | 0.02 | 0.007 | 0.10 | 0.005 | | | 1.0 | | 0.235 |
| 3 | 0.07 | 0.01 | 1.5 | 0.01 | 0.002 | 0.04 | 0.004 | 0.11 | | 0.25 | | 0.086 |
| 4 | 0.08 | 0.01 | 1.1 | 0.10 | 0.01 | 0.05 | 0.006 | 0.21 | 0.05 | 0.10 | B = 0.0015 | 0.082 |
| 5 | 0.08 | 0.01 | 1.2 | 0.03 | 0.002 | 0.05 | 0.002 | 0.30 | | | | 0.075 |
| 6 | 0.18 | 0.02 | 1.7 | 0.05 | 0.003 | 0.04 | 0.005 | | | 0.65 | | 0.153 |
| 7 | 0.16 | 0.02 | 1.4 | 0.02 | 0.01 | 0.06 | 0.004 | 0.04 | | 0.43 | | 0.111 |
| 8 | 0.17 | 0.02 | 1.1 | 0.03 | 0.03 | 0.04 | 0.005 | | | 0.73 | Mo = 0.02, Ta = 0.02, W = 0.03, Cr = 0.05, Ni = 0.05, Cu = 0.10, Ca = 0.003, REM = 0.001, Sb = 0.010, B = 0.0010 | 0.172 |
| 9 | 0.15 | 0.1 | 0.9 | 0.03 | 0.005 | 0.05 | 0.006 | 0.05 | | 0.42 | Mo = 0.05, Cr = 0.15, Ca = 0.005 | 0.111 |
| 10 | 0.11 | 0.01 | 1.1 | 0.01 | 0.001 | 0.06 | 0.003 | 0.10 | | 0.30 | | 0.096 |
| 11 | 0.12 | 0.01 | 1.2 | 0.01 | 0.001 | 0.06 | 0.005 | | 0.10 | 0.33 | Mo = 0.2, Ni = 0.3, Cr = 0.3 | 0.091 |
| 12 | 0.11 | 0.01 | 1.1 | 0.01 | 0.001 | 0.05 | 0.004 | 0.05 | | 0.35 | | 0.095 |
| 13 | 0.15 | 0.01 | 1.3 | 0.05 | 0.002 | 0.07 | 0.007 | 0.15 | | 0.33 | Sb = 0.010 | 0.115 |
| 14 | 0.12 | 0.3 | 1.3 | 0.03 | 0.01 | 0.02 | 0.004 | 0.05 | 0.03 | 0.34 | Mo = 0.10 | 0.096 |
| 15 | 0.12 | 0.05 | 1.4 | 0.02 | 0.001 | 0.02 | 0.005 | 0.15 | | 0.25 | W = 0.01, Ni = 0.11, Ca = 0.004, Sb = 0.015 | 0.096 |
| 16 | 0.15 | 0.03 | 1.9 | 0.02 | 0.001 | 0.09 | 0.008 | 0.11 | | 0.42 | | 0.126 |
| 17 | 0.12 | 0.1 | 1.6 | 0.06 | 0.03 | 0.03 | 0.005 | 0.05 | 0.05 | 0.35 | Cr = 0.1, Ni = 0.2 | 0.101 |
| 18 | 0.16 | 0.02 | 0.8 | 0.01 | 0.005 | 0.04 | 0.007 | | 0.01 | 0.63 | Cr = 0.3 | 0.150 |
| 19 | 0.20 | 0.02 | 1.2 | 0.01 | 0.003 | 0.08 | 0.008 | 0.01 | 0.05 | 0.65 | Mo = 0.15, Cr = 0.2 | 0.162 |
| 20 | 0.09 | 0.6 | 1.3 | 0.05 | 0.003 | 0.03 | 0.006 | 0.11 | | 0.22 | | 0.079 |
| 21 | 0.11 | 0.3 | 0.7 | 0.01 | 0.002 | 0.06 | 0.002 | | | 0.41 | Cr = 0.2 | 0.096 |
| 22 | 0.09 | 0.01 | 1.2 | 0.10 | 0.01 | 0.05 | 0.006 | 0.25 | 0.10 | | Ca = 0.003 | 0.075 |
| 23 | 0.15 | 0.02 | 1.5 | 0.01 | 0.002 | 0.05 | 0.010 | | 0.10 | 0.33 | | 0.091 |
| 24 | 0.11 | 0.2 | 1.2 | 0.02 | 0.001 | 0.06 | 0.006 | | | 0.35 | | 0.082 |

TABLE 1-continued

| Sample | Chemical Composition (mass %) | | | | | | | | | | | |
|---|---|---|---|---|---|---|---|---|---|---|---|---|
| No. | C | Si | Mn | P | S | Al | N | Ti | Nb | V | Other | C* |
| 25 | 0.18 | 0.08 | 1.8 | 0.02 | 0.03 | 0.06 | 0.005 | 0.05 | | 0.56 | | 0.144 |
| 26 | 0.11 | 0.01 | 1.2 | 0.01 | 0.002 | 0.03 | 0.004 | 0.12 | | 0.13 | | 0.061 |
| 27 | 0.09 | 0.06 | 1.5 | 0.03 | 0.005 | 0.03 | 0.004 | 0.30 | 0.05 | 0.01 | Mo = 0.05, Ta = 0.06, W = 0.03 | 0.084 |
| 28 | 0.14 | 0.4 | 1.3 | 0.04 | 0.001 | 0.08 | 0.003 | 0.04 | | 0.45 | Sb = 0.013 | 0.116 |
| 29 | 0.15 | 0.03 | 1.5 | 0.01 | 0.002 | 0.07 | 0.006 | 0.08 | | 0.47 | | 0.131 |
| 30 | 0.09 | 0.02 | 1.8 | 0.08 | 0.04 | 0.05 | 0.007 | 0.13 | | 0.15 | | 0.068 |

Underlined portions indicate items out of the range of the disclosed embodiments.

TABLE 2

| | Hot Rolling | | | | | | | | | | | |
|---|---|---|---|---|---|---|---|---|---|---|---|---|
| | Stand 1 | | | Stand 2 | | | Stand 3 | | | Stand 4 | | |
| Sample No. | $r_1$ | $T_1$ (° C.) | Accumulated Strain $R_1$ | $r_2$ | $T_2$ (° C.) | Accumulated Strain $R_2$ | $r_3$ | $T_3$ (° C.) | Accumulated Strain $R_3$ | $r_4$ | $T_4$ (° C.) | Accumulated Strain $R_4$ |
| 1 | 0.29 | 1050 | 0.15 | 0.30 | 1030 | 0.17 | 0.33 | 1020 | 0.20 | 0.26 | 1000 | 0.17 |
| 2 | 0.39 | 950 | 0.36 | 0.28 | 940 | 0.26 | 0.35 | 920 | 0.33 | 0.36 | 900 | 0.34 |
| 3 | 0.37 | 1020 | 0.19 | 0.35 | 1000 | 0.21 | 0.33 | 980 | 0.21 | 0.29 | 970 | 0.19 |
| 4 | 0.35 | 1100 | 0.06 | 0.31 | 1090 | 0.07 | 0.29 | 1080 | 0.08 | 0.25 | 1060 | 0.09 |
| 5 | 0.33 | 950 | 0.23 | 0.34 | 930 | 0.25 | 0.32 | 910 | 0.25 | 0.26 | 900 | 0.21 |
| 6 | 0.29 | 970 | 0.24 | 0.29 | 950 | 0.25 | 0.30 | 930 | 0.26 | 0.29 | 920 | 0.26 |
| 7 | 0.35 | 1060 | 0.17 | 0.31 | 1040 | 0.17 | 0.28 | 1020 | 0.17 | 0.32 | 1000 | 0.21 |
| 8 | 0.37 | 1030 | 0.28 | 0.35 | 1020 | 0.27 | 0.27 | 1010 | 0.21 | 0.27 | 1000 | 0.22 |
| 9 | 0.33 | 1000 | 0.22 | 0.36 | 980 | 0.26 | 0.28 | 970 | 0.21 | 0.25 | 950 | 0.19 |
| 10 | 0.35 | 1040 | 0.17 | 0.35 | 1020 | 0.20 | 0.33 | 1000 | 0.20 | 0.31 | 980 | 0.21 |
| 11 | 0.36 | 1000 | 0.22 | 0.32 | 980 | 0.21 | 0.27 | 960 | 0.19 | 0.25 | 940 | 0.19 |
| 12 | 0.35 | 990 | 0.23 | 0.33 | 970 | 0.23 | 0.30 | 950 | 0.22 | 0.26 | 930 | 0.20 |
| 13 | 0.35 | 1030 | 0.21 | 0.29 | 1010 | 0.19 | 0.25 | 990 | 0.18 | 0.26 | 970 | 0.19 |
| 14 | 0.35 | 1100 | 0.09 | 0.33 | 1080 | 0.11 | 0.33 | 1070 | 0.13 | 0.31 | 1050 | 0.14 |
| 15 | 0.37 | 970 | 0.26 | 0.33 | 950 | 0.25 | 0.30 | 940 | 0.23 | 0.25 | 930 | 0.20 |
| 16 | 0.32 | 1050 | 0.19 | 0.33 | 1040 | 0.20 | 0.31 | 1030 | 0.20 | 0.26 | 1020 | 0.17 |
| 17 | 0.34 | 1050 | 0.16 | 0.33 | 1040 | 0.17 | 0.30 | 1020 | 0.17 | 0.29 | 1010 | 0.18 |
| 18 | 0.36 | 1060 | 0.23 | 0.31 | 1050 | 0.20 | 0.35 | 1040 | 0.24 | 0.22 | 1020 | 0.16 |
| 19 | 0.32 | 1080 | 0.20 | 0.33 | 1060 | 0.22 | 0.29 | 1040 | 0.21 | 0.25 | 1020 | 0.19 |
| 20 | 0.30 | 1050 | 0.11 | 0.29 | 1030 | 0.13 | 0.28 | 1020 | 0.14 | 0.29 | 1000 | 0.16 |
| 21 | 0.29 | 1010 | 0.17 | 0.28 | 980 | 0.19 | 0.30 | 970 | 0.21 | 0.28 | 960 | 0.20 |
| 22 | 0.38 | 1090 | 0.06 | 0.33 | 1080 | 0.07 | 0.31 | 1060 | 0.10 | 0.29 | 1040 | 0.12 |
| 23 | 0.30 | 1100 | 0.06 | 0.30 | 1080 | 0.09 | 0.28 | 1070 | 0.10 | 0.33 | 1050 | 0.14 |
| 24 | 0.28 | 980 | 0.18 | 0.30 | 970 | 0.20 | 0.28 | 950 | 0.20 | 0.26 | 930 | 0.20 |
| 25 | 0.28 | 1010 | 0.20 | 0.33 | 990 | 0.25 | 0.22 | 970 | 0.18 | 0.26 | 950 | 0.22 |
| 26 | 0.34 | 1020 | 0.14 | 0.35 | 1000 | 0.17 | 0.29 | 980 | 0.16 | 0.25 | 960 | 0.15 |
| 27 | 0.41 | 1070 | 0.13 | 0.35 | 1050 | 0.14 | 0.25 | 1040 | 0.11 | 0.31 | 1020 | 0.16 |
| 28 | 0.30 | 980 | 0.22 | 0.29 | 960 | 0.22 | 0.28 | 950 | 0.22 | 0.28 | 940 | 0.22 |
| 29 | 0.33 | 1040 | 0.21 | 0.30 | 1030 | 0.19 | 0.27 | 1010 | 0.19 | 0.26 | 990 | 0.19 |
| 30 | 0.33 | 1030 | 0.13 | 0.31 | 1020 | 0.14 | 0.28 | 1000 | 0.14 | 0.24 | 980 | 0.14 |

| | Hot Rolling | | | | | | | | | | |
|---|---|---|---|---|---|---|---|---|---|---|---|
| | Stand 5 | | | Stand 6 | | | Stand 7 | | | | Finishing |
| Sample No. | $r_5$ | $T_5$ (° C.) | Accumulated Strain $R_5$ | $r_6$ | $T_6$ (° C.) | Accumulated Strain $R_6$ | $r_7$ | $T_7$ (° C.) | Accumulated Strain $R_7$ | Cumulative Strain $R_t$ | Delivery Temperature (° C.) |
| 1 | 0.22 | 990 | 0.15 | 0.19 | 970 | 0.14 | 0.14 | 960 | 0.10 | 1.1 | 940 |
| 2 | 0.33 | 880 | 0.32 | 0.21 | 870 | 0.20 | 0.14 | 860 | 0.14 | 2.0 | 850 |
| 3 | 0.26 | 950 | 0.19 | 0.23 | 940 | 0.17 | 0.18 | 930 | 0.14 | 1.3 | 920 |
| 4 | 0.24 | 1040 | 0.10 | 0.19 | 1020 | 0.10 | 0.22 | 1000 | 0.13 | 0.6 | 980 |
| 5 | 0.25 | 880 | 0.21 | 0.22 | 870 | 0.19 | 0.14 | 860 | 0.12 | 1.4 | 850 |
| 6 | 0.25 | 900 | 0.23 | 0.22 | 890 | 0.20 | 0.18 | 870 | 0.17 | 1.6 | 860 |
| 7 | 0.26 | 980 | 0.19 | 0.21 | 970 | 0.15 | 0.19 | 950 | 0.15 | 1.2 | 930 |
| 8 | 0.24 | 980 | 0.20 | 0.24 | 960 | 0.21 | 0.20 | 940 | 0.18 | 1.6 | 930 |
| 9 | 0.25 | 930 | 0.20 | 0.18 | 920 | 0.15 | 0.24 | 900 | 0.20 | 1.4 | 880 |
| 10 | 0.28 | 960 | 0.20 | 0.26 | 950 | 0.19 | 0.19 | 940 | 0.14 | 1.3 | 920 |
| 11 | 0.27 | 920 | 0.21 | 0.24 | 900 | 0.20 | 0.18 | 880 | 0.15 | 1.4 | 870 |
| 12 | 0.25 | 910 | 0.20 | 0.22 | 890 | 0.19 | 0.20 | 870 | 0.17 | 1.4 | 860 |
| 13 | 0.21 | 960 | 0.16 | 0.30 | 940 | 0.24 | 0.21 | 920 | 0.17 | 1.3 | 900 |
| 14 | 0.36 | 1030 | 0.19 | 0.20 | 1020 | 0.11 | 0.21 | 1000 | 0.13 | 0.9 | 980 |
| 15 | 0.26 | 910 | 0.21 | 0.24 | 900 | 0.20 | 0.15 | 880 | 0.13 | 1.5 | 870 |

TABLE 2-continued

| | | | | | | | | | | | |
|---|---|---|---|---|---|---|---|---|---|---|---|
| 16 | 0.26 | 1000 | 0.18 | 0.20 | 980 | 0.15 | 0.15 | 960 | 0.12 | 1.2 | 940 |
| 17 | 0.22 | 990 | 0.15 | 0.22 | 970 | 0.16 | 0.20 | 950 | 0.15 | 1.1 | 930 |
| 18 | 0.24 | 1010 | 0.18 | 0.22 | 990 | 0.17 | 0.21 | 970 | 0.17 | 1.3 | 950 |
| 19 | 0.27 | 1000 | 0.21 | 0.25 | 980 | 0.20 | 0.18 | 970 | 0.15 | 1.4 | 950 |
| 20 | 0.24 | 980 | 0.15 | 0.24 | 960 | 0.16 | 0.16 | 940 | 0.12 | 1.0 | 930 |
| 21 | 0.25 | 950 | 0.19 | 0.22 | 930 | 0.17 | 0.18 | 910 | 0.15 | 1.3 | 890 |
| 22 | 0.25 | 1020 | 0.12 | 0.25 | 1000 | 0.14 | 0.22 | 980 | 0.13 | 0.7 | 970 |
| 23 | 0.35 | 1030 | 0.18 | 0.25 | 1010 | 0.14 | 0.16 | 980 | 0.11 | 0.8 | 970 |
| 24 | 0.26 | 910 | 0.21 | 0.23 | 890 | 0.19 | 0.17 | 870 | 0.14 | 1.3 | 860 |
| 25 | 0.22 | 940 | 0.19 | 0.28 | 920 | 0.24 | 0.17 | 900 | 0.15 | 1.4 | 880 |
| 26 | 0.25 | 950 | 0.16 | 0.19 | 930 | 0.13 | 0.17 | 910 | 0.13 | 1.0 | 890 |
| 27 | 0.25 | 1010 | 0.14 | 0.21 | 990 | 0.13 | 0.16 | 970 | 0.11 | 0.9 | 960 |
| 28 | 0.27 | 930 | 0.22 | 0.21 | 910 | 0.18 | 0.17 | 880 | 0.15 | 1.4 | 860 |
| 29 | 0.26 | 970 | 0.20 | 0.23 | 950 | 0.19 | 0.18 | 930 | 0.15 | 1.3 | 910 |
| 30 | 0.23 | 960 | 0.15 | 0.21 | 940 | 0.15 | 0.18 | 920 | 0.13 | 1.0 | 840 |

| | Hot Rolling | | Annealing | | Treatment after Coating | | | |
|---|---|---|---|---|---|---|---|---|
| Sample No. | Average Cooling Rate*1 (° C./s) | Coiling Temperature (° C.) | Soaking Temperature (° C.) | Soaking Time (s) | Reheating Temperature (° C.) | Holding Time (s) | Average Cooling Rate*2 (° C./s) | Thickness Reduction Ratio (%) |
| 1 | 120 | 540 | 730 | 150 | 500 | 2 | 7 | 2.0 |
| 2 | 40 | 430 | 650 | 70 | — | — | 9 | 0.3 |
| 3 | 50 | 550 | 700 | 50 | — | — | 8 | — |
| 4 | 90 | 490 | 680 | 80 | 510 | 2 | 9 | 0.1 |
| 5 | 30 | 600 | 700 | 80 | — | — | 5 | — |
| 6 | 70 | 450 | 780 | 30 | 530 | 1 | 8 | 0.1 |
| 7 | 50 | 610 | 730 | 110 | 520 | 2 | 8 | — |
| 8 | 80 | 510 | 700 | 90 | 570 | 2 | 6 | 0.2 |
| 9 | 80 | 520 | 770 | 250 | 600 | 1 | 6 | 1.0 |
| 10 | 80 | 550 | 750 | 50 | 550 | 2 | 8 | 0.1 |
| 11 | 90 | 550 | 730 | 320 | 530 | 2 | 7 | — |
| 12 | 80 | 560 | 710 | 30 | 520 | 2 | 11 | — |
| 13 | 50 | 500 | 720 | 200 | — | — | 7 | 3.0 |
| 14 | 70 | 480 | 760 | 300 | — | — | 7 | — |
| 15 | 50 | 350 | 710 | 10 | 530 | 3 | 4 | 0.2 |
| 16 | 50 | 480 | 740 | 120 | 470 | 3 | 7 | — |
| 17 | 20 | 520 | 740 | 100 | 510 | 1 | 7 | — |
| 18 | 110 | 570 | 750 | 90 | — | — | 8 | — |
| 19 | 200 | 400 | 740 | 60 | 460 | 5 | 10 | 0.1 |
| 20 | 80 | 500 | 730 | 30 | — | — | 8 | 0.2 |
| 21 | 30 | 450 | 750 | 50 | 530 | 2 | 5 | — |
| 22 | 90 | 490 | 680 | 80 | 510 | 2 | 9 | 0.1 |
| 23 | 150 | 380 | 730 | 30 | — | — | 8 | — |
| 24 | 80 | 520 | 740 | 8 | 540 | 2 | 9 | 0.5 |
| 25 | 60 | 490 | 710 | 110 | 550 | 2 | 4 | — |
| 26 | 80 | 520 | 730 | 130 | — | — | 5 | 0.1 |
| 27 | 70 | 560 | 690 | 120 | 520 | 3 | 3 | — |
| 28 | 80 | 400 | 640 | 70 | — | — | 6 | — |
| 29 | 60 | 340 | 720 | 80 | 530 | 1 | 7 | 1.0 |
| 30 | 70 | 530 | 720 | 150 | 480 | 2 | 6 | — |

Underlined portions indicate items out of the range of the disclosed embodiments.

*1Average cooling rate in a temperature range from the finishing delivery temperature to a temperature of 650° C.

*2Average cooling rate in a temperature range of 400° C. to 200° C.

Test pieces were taken from the samples described above to perform precipitate measurement, microstructure observation, a tensile test, and a punching test. The methods for performing the tests were as follows.

(Amount of Fe Precipitated)

The amount of Fe precipitated was determined by grinding a test piece to ¼ of the thickness to obtain an electrolysis test piece, by setting the electrolysis test piece at the anode, by performing constant-current electrolysis in 10% AA-based electrolytic solution (10 volume % acetylacetone-1 mass % tetramethylammonium chloride-methanol electrolytic solution) to dissolve a certain amount of the test piece and to obtain extraction residue, by filtering the extraction residue through a filter having a filter pore size of 0.2 μm to collect Fe-based precipitates, by dissolving the collected Fe-based precipitates in mixed acid to determine the amount of Fe through ICP emission spectrometry, and by deriving the amount of Fe in Fe-based precipitates (the amount of Fe precipitated) from the determined amount of Fe. Here, since Fe-based precipitates cohere to each other, it is possible to collect Fe-based precipitates having a grain diameter of less than 0.2 μm by using a filter having a filter pore size of 0.2 μm.

(Precipitate C Equivalent of Ti, Nb, and V Precipitated in the Form of Precipitates Having a Grain Diameter of Less than 20 nm)

The precipitate C equivalent of Ti, Nb, and V precipitated in the form of precipitates having a grain diameter of less than 20 nm was determined, as described in Japanese Patent No. 4737278, by grinding a test piece to ¼ of the thickness to obtain an electrolysis test piece, by setting the electrolysis test piece at the anode, by performing constant-current electrolysis in 10% AA-based electrolytic solution to dissolve a certain amount of the test piece, by then performing ultrasonic peeling on the electrolysis test piece in a fluid dispersion to obtain a fluid dispersion containing precipitates adhered to the surface of the test piece, by filtering the obtained fluid dispersion through a filter having a filter pore size of 20 nm to obtain a filtrate, and by determining the amounts of Ti, Nb, and V in the obtained filtrate through ICP emission spectrometry. Here, since all the precipitates of Ti, Nb, and V adhered to the surface of the electrolysis test piece, all the precipitates of Ti, Nb, and V are dispersed in the fluid dispersion described above. In addition, under the assumption that all the precipitates of Ti, Nb, and V are carbides, the value calculated by using the formula ([Ti]/48 +[Nb]/93+[V]/51)×12, where [Ti], [Nb], and [V] are respectively defined as the amounts (mass %) of Ti, Nb, and V precipitated in the form of precipitates having a grain diameter of less than 20 nm, was defined as the precipitate C equivalent of Ti, Nb, and V precipitated in the form of precipitates having a grain diameter of less than 20 nm.

(Proportion of Precipitates Formed at Random in the Group of Precipitates Having a Grain Diameter of Less than 20 nm)

The proportion of precipitates formed at random in the group of precipitates having a grain diameter of less than 20 nm was determined by taking a thin-film test piece from a test piece, by polishing the thin-film test piece to obtain a thin-film sample, by observing the obtained thin-film sample from the {111}-plane by using a transmission electron microscope (TEM), by defining precipitates which were not formed in arrays as precipitates formed at random, and by calculating the proportion of the precipitates formed at random (the proportion of the number of precipitates having a grain diameter of less than 20 nm formed at random to the number of all the precipitates having a grain diameter of less than 20 nm). Here, the expression "half or more of precipitates having a grain diameter of less than 20 nm are formed at random" refers to a case where half or more of all the precipitates having a grain diameter of less than 20 nm are formed at random, that is, a case where the proportion of precipitates formed at random, which is calculated by the formula [(number of precipitates having a grain diameter of less than 20 nm formed at random)/(number of all the precipitates having a grain diameter of less than 20 nm)×100], is 50% or more. In addition, since there may be a case where precipitates formed in arrays are recognized as precipitates formed at random when observation is performed from only one direction, precipitates recognized as those which were not formed in arrays when observation was performed from the {111}-plane were observed again from a direction at an angle of 90° to the first observation direction, and the precipitates recognized again as those which were not formed in arrays were defined as those which were formed at random. In addition, such observation was performed at 10 positions to determine the proportion of precipitates formed at random, and the average value of the proportion for the 10 positions was defined as the proportion of precipitates formed at random in the group of precipitates having a grain diameter of less than 20 nm (random precipitate proportion).

(Microstructure Observation)

The area ratios of a ferrite phase and a tempered bainite phase were determined by taking a microstructure observation test piece from a test piece, by embedding and polishing the surface of the cross section in the rolling-thickness direction of the microstructure observation test piece, by etching the polished surface with nital, by observing the etched surface by using a scanning electron microscope (SEM) at a magnification of 1000 times to obtain the photographs of 3 regions centered at positions located at ¼ of the thickness having a size of 100 μm×100 μm, and by performing image analysis on the SEM photographs. Moreover, the average gran diameter of a microstructure was determined by taking a microstructure observation test piece from a test piece, by embedding and polishing the surface of the cross section in the rolling-thickness direction of the microstructure observation test piece, by etching the polished surface with nital, by observing the etched surface by using an Electron Back Scatter Diffraction (EBSD) method at intervals of 0.1 μm in 3 regions centered at positions located at ¼ of the thickness having a size of 100 μm×100 μm, by defining grain boundaries having a misorientation of 15° or more as grain boundaries, by calculating the circle-equivalent diameter of each of the grains from its area, and by defining the average value of the circle-equivalent diameter as the average grain diameter.

(Tensile Test)

A tensile test was performed in accordance with JIS Z 2241 on a JIS No. 5 tensile test piece which had been taken from a test piece so that the longitudinal direction of the tensile test piece was a direction perpendicular to the rolling direction to evaluate yield strength (YP), tensile strength (TS), and total elongation (El).

(Punching Test)

A punching test was performed on each test piece by punching a hole having a diameter of 10 mm with a clearance of 5% to 30% at intervals of 5% three times for each clearance and by observing the end surface in the worst condition through a loupe. The results were evaluated on a 3-point scale, where a case in which a large crack was observed in the end surface was marked with x, a case in which a microcrack was observed in the end surface was marked with Δ, and a case in which no crack was observed in the end surface was marked with ○, and where a case marked with ○ was judged as satisfactory.

The properties of sample Nos. 1 through 30 are given in Table 3.

TABLE 3

| | Microstructure | | | | | Mechanical Property | | | | | |
|---|---|---|---|---|---|---|---|---|---|---|---|
| Sample No. | Amount of Fe Precipitated (mass %) | Precipitate C Equivalent*1 (mass %) | Random Precipitate Proportion*2 (%) | Area Ratio of Ferrite Phase + Tempered Bainite Phase (%) | Average Grain Diameter (μm) | Thickness (mm) | YP (MPa) | TS (MPa) | El (%) | Punchability | Note |
| 1 | 0.52 | 0.043 | 70 | 98 | 3.3 | 1.5 | 950 | 1030 | 17 | ○ | Example Steel |
| 2 | 0.55 | 0.105 | 100 | 95 | 1.5 | 3.5 | 1250 | 1350 | 11 | ○ | Example Steel |
| 3 | 0.08 | 0.031 | 80 | 98 | 3.2 | 2.5 | 890 | 1000 | 17 | x | Comparative Steel |
| 4 | 0.25 | 0.035 | 80 | 96 | 5.2 | 1.5 | 880 | 980 | 17 | Δ | Comparative Steel |

TABLE 3-continued

| | Microstructure | | | | | Mechanical Property | | | | | |
|---|---|---|---|---|---|---|---|---|---|---|---|
| Sample No. | Amount of Fe Precipitated (mass %) | Precipitate C Equivalent*1 (mass %) | Random Precipitate Proportion*2 (%) | Area Ratio of Ferrite Phase + Tempered Bainite Phase (%) | Average Grain Diameter (μm) | Thickness (mm) | YP (MPa) | TS (MPa) | El (%) | Punchability | Note |
| 5 | 0.10 | 0.052 | 50 | 100 | 3.8 | 1.0 | 910 | 980 | 17 | ○ | Example Steel |
| 6 | 0.65 | 0.033 | 90 | 92 | 2.6 | 1.5 | 970 | 1050 | 16 | Δ | Comparative Steel |
| 7 | 0.51 | 0.043 | 30 | 98 | 3.3 | 1.5 | 930 | 1020 | 17 | x | Comparative Steel |
| 8 | 0.18 | 0.110 | 90 | 99 | 2.5 | 1.5 | 1150 | 1270 | 13 | ○ | Example Steel |
| 9 | 0.67 | 0.055 | 80 | 97 | 2.8 | 1.5 | 920 | 1020 | 17 | ○ | Example Steel |
| 10 | 0.35 | 0.050 | 70 | 98 | 3.5 | 1.5 | 920 | 1000 | 18 | ○ | Example Steel |
| 11 | 0.44 | 0.035 | 70 | 98 | 5.1 | 3.0 | 930 | 1010 | 17 | Δ | Comparative Steel |
| 12 | 0.09 | 0.042 | 70 | 98 | 2.9 | 2.5 | 920 | 1000 | 16 | Δ | Comparative Steel |
| 13 | 0.38 | 0.067 | 90 | 98 | 2.9 | 1.5 | 1000 | 1100 | 16 | ○ | Example Steel |
| 14 | 0.42 | 0.045 | 100 | 98 | 4.5 | 2.5 | 910 | 1000 | 17 | ○ | Example Steel |
| 15 | 0.44 | 0.045 | 100 | 95 | 3.1 | 2.0 | 920 | 980 | 18 | ○ | Example Steel |
| 16 | 0.58 | 0.054 | 80 | 90 | 2.6 | 2.0 | 950 | 1070 | 16 | Δ | Comparative Steel |
| 17 | 0.45 | 0.043 | 40 | 97 | 3.2 | 2.5 | 920 | 1010 | 17 | Δ | Comparative Steel |
| 18 | 0.33 | 0.081 | 60 | 98 | 3.6 | 1.5 | 1080 | 1150 | 15 | ○ | Example Steel |
| 19 | 0.67 | 0.095 | 100 | 96 | 2.2 | 3.0 | 1100 | 1200 | 14 | ○ | Example Steel |
| 20 | 0.35 | 0.032 | 40 | 99 | 6.2 | 2.5 | 900 | 990 | 18 | x | Comparative Steel |
| 21 | 0.42 | 0.052 | 80 | 96 | 5.8 | 1.5 | 910 | 1010 | 17 | x | Comparative Steel |
| 22 | 0.31 | 0.025 | 100 | 98 | 5.0 | 1.5 | 900 | 980 | 19 | ○ | Example Steel |
| 23 | 0.61 | 0.035 | 100 | 96 | 4.1 | 4.0 | 910 | 990 | 19 | ○ | Example Steel |
| 24 | 0.43 | 0.024 | 80 | 97 | 3.1 | 1.5 | 920 | 1000 | 17 | Δ | Comparative Steel |
| 25 | 0.62 | 0.078 | 100 | 97 | 2.4 | 2.0 | 1060 | 1180 | 14 | ○ | Example Steel |
| 26 | 0.35 | 0.022 | 70 | 97 | 4.1 | 2.5 | 870 | 950 | 18 | x | Comparative Steel |
| 27 | 0.15 | 0.038 | 70 | 98 | 3.9 | 1.5 | 910 | 980 | 18 | ○ | Example Steel |
| 28 | 0.56 | 0.022 | 100 | 96 | 2.9 | 2.5 | 1060 | 1080 | 16 | x | Comparative Steel |
| 29 | 0.55 | 0.052 | 100 | 93 | 3.1 | 1.5 | 1000 | 1110 | 15 | Δ | Comparative Steel |
| 30 | 0.31 | 0.023 | 70 | 97 | 4.2 | 1.5 | 890 | 970 | 17 | Δ | Comparative Steel |

Underlined portions indicate items out of the range of the disclosed embodiments.

*1Precipitate C equivalent of Ti, Nb, and V precipitated in the form of precipitates having a grain diameter of less than 20 nm

Figure 2:
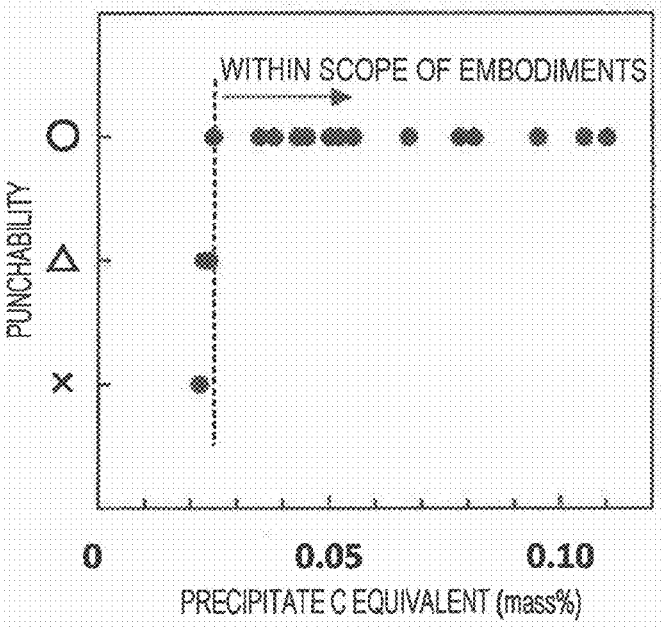
FIG. 2 is a diagram illustrating the relationship between a precipitate C equivalent and punchability.
Figure 3:
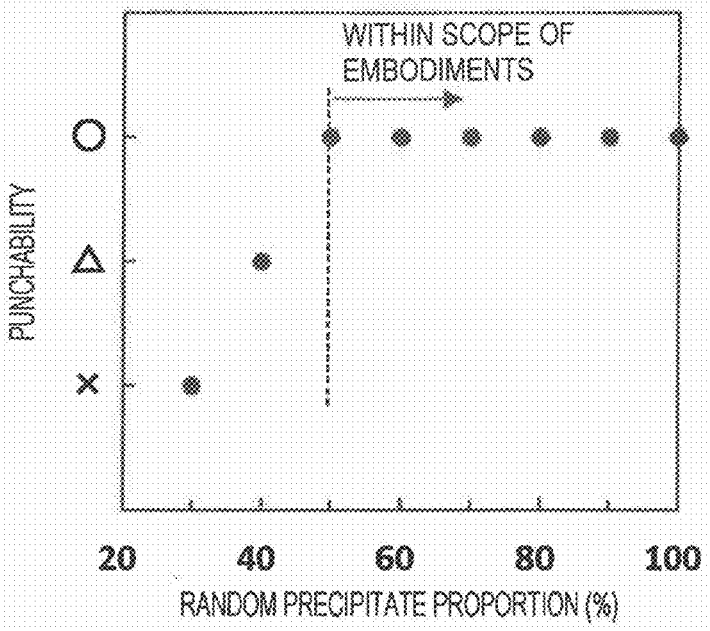
FIG. 3 is a diagram illustrating the relationship between a random precipitate proportion and punchability.
Figure 4:
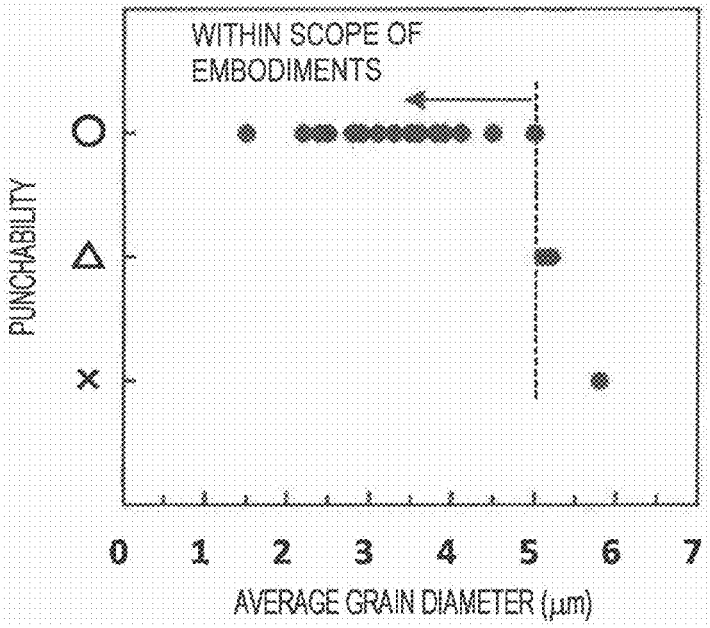
FIG. 4 is a diagram illustrating the relationship between the average grain diameter of a microstructure and punchability.

*2Proportion of precipitates formed at random in the group of precipitates having a grain diameter of less than 20 nm In addition, FIG. 1 illustrates the relationship between the amount of Fe precipitated and punchability in the case of the example steels and the comparative steels in which only the amount of Fe precipitated was out of the range of the disclosed embodiments. It is clarified that, by controlling the amount of Fe precipitated to be within the range of the disclosed embodiments, it is possible to ensure no crack in a punching test. FIG. 2 illustrates the relationship between a precipitate C equivalent and punchability in the case of the example steels and the comparative steels in which only the precipitate C equivalent was out of the range of the disclosed embodiments. It is clarified that, by controlling the precipitate C equivalent to be within the range of the disclosed embodiments, it is possible to ensure no crack in a punching test. FIG. 3 illustrates the relationship between a random precipitate proportion and punchability in the case of the example steels and the comparative steels in which only the random precipitate proportion was out of the range of the disclosed embodiments. It is clarified that, by controlling the random precipitate proportion to be within the range of the disclosed embodiments, it is possible to ensure no crack in a punching test. FIG. 4 illustrates the relationship between the average grain diameter of a microstructure and punchability in the case of the example steels and the comparative steels in which only the average grain diameter of a microstructure was out of the range of the disclosed embodiments. It is clarified that, by controlling the average grain diameter of a microstructure to be within the range of the disclosed embodiments, it is possible to ensure no crack in a punching test.

The invention claimed is:

1. A galvanized steel sheet having a chemical composition comprising, by mass %:

C: 0.08% to 0.20%,

Si: 0.5% or less,

Mn: 0.8% to 1.8%,

P: 0.10% or less,

S: 0.030% or less,

Al: 0.10% or less,

N: 0.010% or less, at least one selected from the group consisting of Ti: 0.01% to 0.3%, Nb: 0.01% to 0.1%, and V: 0.01% to 1.0%, in which C* derived using equation (1) is 0.07 or more:

$$C^*=(Ti/48+Nb/93+V/51)\times 12 \quad (1),$$

where, the atomic symbols in equation (1) respectively denote the contents by mass % of the corresponding elements, and a balance of Fe and inevitable impurities, wherein the steel sheet has a microstructure including a ferrite phase and a tempered bainite phase in a total amount of 95% or more in terms of area ratio, an average grain diameter of the microstructure is 5.0 μm or less, an amount of Fe precipitated is 0.10 mass % or more, an amount of Ti, Nb, and V precipitated in a form of precipitates having a grain diameter of less than 20 nm is 0.025 mass % or more in terms of precipitate C equivalent derived using formula (2):

$$([Ti]/48+[Nb]/93+[V]/51)\times 12 \quad (2),$$

where, [Ti], [Nb], and [V] in equation (2) respectively denote the amounts by mass % of Ti, Nb, and V precipitated in the form of precipitates having a grain diameter of less than 20 nm, and at least half of precipitates having a grain diameter of less than 20 nm are formed at random.

2. The galvanized steel sheet according to claim 1, wherein the chemical composition further comprises, by mass %, at least one Group selected from the group consisting of:

Group A: at least one selected from the group consisting of Mo: 0.005% to 0.50%, Ta: 0.005% to 0.50%, and W: 0.005% to 0.50%, Group B: at least one selected from the group consisting of Cr: 0.01% to 1.0%, Ni: 0.01% to 1.0%, and Cu: 0.01% to 1.0%, Group C: at least one selected from the group consisting of Ca: 0.0005% to 0.01% and REM: 0.0005% to 0.01%, Group D: Sb: 0.005% to 0.050%, and Group E: B: 0.0005% to 0.0030%.

3. A method for manufacturing a galvanized steel sheet, the method comprising:

casting steel having the chemical composition according to claim 1 to obtain a slab;

performing rough rolling on the slab which is in a cast state or has been subjected to cooling followed by reheating to a temperature of 1200° C. or higher;

performing finish rolling on the rough-rolled slab with a finishing delivery temperature of 850° C. or higher so that a cumulative strain, which is a sum of accumulated strains $R_1$ through $R_m$ of finish rolling utilizing m stands, is 0.7 or more, where $r_n$ is defined as a rolling reduction ratio of the n-th stand, where $T_n$ (° C.) is defined as a temperature at an entry side of the n-th stand, and where $R_n$ is defined as an accumulated strain in the n-th stand and calculated by using the equation $R_n=r_n(1-\exp\{-11000(1+C^*)/(T_n+273)+8.5\})$ with the proviso that where a value of the expression $\exp\{-11000(1+C^*)/(T_n+273)+8.5\}$ is more than 1, the expression is assigned a value of 1;

cooling the finish-rolled steel sheet at an average cooling rate of 30° C./s or more in a temperature range from the finishing delivery temperature to a temperature of 650° C.;

coiling the cooled steel sheet at a coiling temperature in a range of 350° C. or higher and 600° C. or lower, and pickling the coiled steel sheet;

annealing the pickled steel sheet at a soaking temperature in a range of 650° C. to 770° C. for a soaking time in a range of 10 seconds to 300 seconds;

dipping the annealed steel sheet in a galvanizing bath having a temperature in a range of 420° C. to 500° C. to galvanize the annealed steel sheet; and cooling the galvanized steel sheet at an average cooling rate of 10° C./s or less at a temperature in a range of 400° C. to 200° C.

4. The method for manufacturing a galvanized steel sheet according to claim 3, further comprising reheating the steel sheet, after the dipping in the galvanizing bath having the temperature in the range of 420° C. to 500° C. to galvanize the steel sheet, to a temperature in a range of 460° C. to 600° C., holding the reheated steel sheet for 1 second or more, and then cooling the held steel sheet at the average cooling rate of 10° C./s or less at the temperature in the range of 400° C. to 200° C.

5. The method for manufacturing a galvanized steel sheet according to claim 3, further comprising performing work on the steel sheet, after the cooling at the average cooling rate of 10° C./s or less at the temperature in the range of 400° C. to 200° C., with a thickness reduction ratio in a range of 0.1% to 3.0%.

6. A method for manufacturing a galvanized steel sheet, the method comprising:

casting steel having the chemical composition according to claim 2 to obtain a slab;

performing rough rolling on the slab which is in a cast state or has been subjected to cooling followed by reheating to a temperature of 1200° C. or higher;

performing finish rolling on the rough-rolled slab with a finishing delivery temperature of 850° C. or higher so that a cumulative strain, which is a sum of accumulated strains $R_1$ through $R_m$ of finish rolling utilizing m stands, is 0.7 or more, where $r_n$ is defined as a rolling reduction ratio of the n-th stand, where $T_n$ (° C.) is defined as a temperature at an entry side of the n-th stand, and where $R_n$ is defined as an accumulated strain in the n-th stand and calculated by using the equation $R_n=r_n(1-\exp\{-11000(1+C^*)/(T_n+273)+8.5\})$ with the proviso that where a value of the expression $\exp\{-11000(1+C^*)/(T_n+273)+8.5\}$ is more than 1, the expression is assigned a value of 1;

cooling the finish-rolled steel sheet at an average cooling rate of 30° C./s or more in a temperature range from the finishing delivery temperature to a temperature of 650° C.;

coiling the cooled steel sheet at a coiling temperature in a range of 350° C. or higher and 600° C. or lower, and pickling the coiled steel sheet;

annealing the pickled steel sheet at a soaking temperature in a range of 650° C. to 770° C. for a soaking time in a range of 10 seconds to 300 seconds;

dipping the annealed steel sheet in a galvanizing bath having a temperature in a range of 420° C. to 500° C. to galvanize the annealed steel sheet; and cooling the galvanized steel sheet at an average cooling rate of 10° C./s or less at a temperature in a range of 400° C. to 200° C.

7. The method for manufacturing a galvanized steel sheet according to claim 6, further comprising reheating the steel sheet, after the dipping in the galvanizing bath having the temperature in the range of 420° C. to 500° C. to galvanize the steel sheet, to a temperature in a range of 460° C. to 600° C., holding the reheated steel sheet for 1 second or more, and then cooling the held steel sheet at the average cooling rate of 10° C./s or less at the temperature in the range of 400° C. to 200° C.

8. The method for manufacturing a galvanized steel sheet according to claim 6, further comprising performing work on the steel sheet, after the cooling at the average cooling rate of 10° C./s or less at the temperature in the range of 400° C. to 200° C., with a thickness reduction ratio in a range of 0.1% to 3.0%.

9. The method for manufacturing a galvanized steel sheet according to claim 4, further comprising performing work on the steel sheet, after the cooling at the average cooling rate of 10° C./s or less at the temperature in the range of 400° C. to 200° C., with a thickness reduction ratio in a range of 0.1% to 3.0%.

10. The method for manufacturing a galvanized steel sheet according to claim 7, further comprising performing work on the steel sheet, after the cooling at the average cooling rate of 10° C./s or less at the temperature in the range of 400° C. to 200° C., with a thickness reduction ratio in a range of 0.1% to 3.0%.

* * * * *